US006164874A

United States Patent [19]

May

[11] Patent Number: 6,164,874

[45] Date of Patent: Dec. 26, 2000

[54] SHEETING DEVICE

[75] Inventor: Helmut May, Wassenberg, Germany

[73] Assignee: Emunds & Staudinger GmbH, Huckelhoven, Germany

[21] Appl. No.: 09/204,333

[22] Filed: Dec. 2, 1998

[30] Foreign Application Priority Data

Dec. 3, 1997 [DE] Germany ..... 197 53 561

[51] Int. Cl.[7] ..... E21D 5/12

[52] U.S. Cl. ..... 405/283; 405/282

[58] Field of Search ..... 405/282, 283, 405/272, 273

[56] References Cited

U.S. PATENT DOCUMENTS

| | | | |
|---|---|---|---|
| 4,054,033 | 10/1977 | Pillosio | 405/282 |
| 4,145,891 | 3/1979 | Krings | 405/282 |
| 5,310,289 | 5/1994 | Hess | 405/283 X |
| 5,503,504 | 4/1996 | Hess et al. | 405/283 X |

FOREIGN PATENT DOCUMENTS

| | | |
|---|---|---|
| 0 046 553 A | 3/1982 | European Pat. Off. . |
| 0 100 083 A1 | 2/1984 | European Pat. Off. . |
| 0 100 083 B1 | 2/1984 | European Pat. Off. . |
| 90 12 301 U | 11/1990 | Germany . |
| 296 16 986 U | 11/1996 | Germany . |

*Primary Examiner*—Dennis L. Taylor
*Attorney, Agent, or Firm*—Hutchins, Wheeler & Dittmar

[57] ABSTRACT

A sheeting device includes a column with two supporting surfaces in one guide channel. The second supporting surface is provided with an offset relative to the first supporting surface. The offset is both toward the middle of the column in the lengthwise direction of the trench and also in the transverse direction toward the wall of the trench, with one edge of an outer plate of the sheeting device abutting this second supporting surface. As a result of the two supporting surfaces that are offset with respect to one another in the lengthwise and transverse directions of the trench, the guide channel offers each of the plates support in extension of the lengthwise extent of the respective plate. Two inwardly projecting supporting edges on the outer plates are dispensable. Eliminating these supporting edges has the additional advantage that the stacked volume of the outer plates is reduced by approximately half.

16 Claims, 2 Drawing Sheets

SHEETING DEVICE

BACKGROUND OF THE INVENTION

1. Field of the Invention

The invention relates to a sheeting device for supporting the walls of a trench with a stepped cross section, and more particularly to a sheeting device having pairs of plates that are guided on and held in place by columns.

2. Description of Related Art

A conventional sheeting device is disclosed, for example, in European Patent No. 0 100 083 of the present applicant. The known sheeting device has a guide plane formed by a wall of the column that is located in the interior of the trench against which the marginal areas of a pair of plates (i.e., trench liners) abut. A lower and inner plate is made slightly shorter than an upper and outer plate. At the edge of the upper and outer plates, a projecting supporting edge is formed that is directed inward and that fits around the marginal area of the lower inner plate so that the edges of both plates rest on the guide plane next to one another. The advantage of these sheeting devices lies in the simple and open design of a single guide channel to receive the edges of the inner and outer plates.

In order for the marginal area of the outer plate to fit around the marginal area of the inner plate, the outer plates are provided with supporting edges that project inward. The production of these supporting edges that project and are located on both sides of an outer plate is labor and cost intensive. In addition, these projecting supporting edges can easily be damaged during loading, transport, and unloading of the plates as well as during assembly of the sheeting device. Finally, stacked outer plates take up an unnecessarily large volume of space.

It is desirable to provide a sheeting device that makes it possible to support both plates in a single guide channel without the marginal area of one plate having to fit around a marginal area of another plate.

SUMMARY OF THE INVENTION

According to the present invention, a second supporting surface is provided in each of the guide channels of the columns, the area being offset relative to the first supporting area, both toward the middle of the column in the lengthwise direction of the trench and also in the transverse direction toward the wall of the trench, with one edge of the outer plate abutting this second supporting surface.

As a result of the two supporting surfaces that are offset with respect to one another in the lengthwise and transverse directions of the trench, the guide channel offers each of the plates support in extension of the lengthwise extent of the respective plate. The two inwardly projecting supporting edges on the outer plates are dispensable. Eliminating these supporting edges has the additional advantage that the stacked volume of the outer plates is reduced by approximately half.

The second supporting area is offset by at least the thickness of the edge of the inner plate that rests on the first supporting surface with respect to the first supporting surface. The edges of the plates that abut the supporting surfaces can be formed by lateral projections whose thickness is less than the thickness of the plates. As a result, the column can be made so compact that it does not project into the interior of the trench and its inside wall is flush with the inside wall of the inner plates.

The second supporting surface is preferably formed by the end face of a supporting body fastened in the guide channel.

This supporting body can have a surface that runs at right angles to its end face and serves as a contact surface for the edge of the inner plate.

A spacing body can be fastened in the guide channel whose end face forms the first supporting surface for the marginal area of the lower and inner plate.

To provide interlocking connection for engagingly holding together the plates and columns in the lengthwise direction of the trench, a projecting strip is preferably fastened to the wall of the guide channel that faces the wall of the trench, with a projecting strip on the edge of the outer plate engaging behind the strip on the wall of the guide channel. This design has the additional advantage that the edge of the outer plate does not necessarily have to be inserted in the vertical direction into the guide channel but can be placed in the guide channel by pivoting it in laterally.

Preferably, the supporting bodies and, if any, the spacing bodies are each formed by a steel profile bent at right angles that is welded at least to the wall of the guide channel that faces the inside of the trench. The steel profiles can be bent in simple fashion so that they have an L shape in cross section. Alternatively, steel profiles bent twice and having a cross section in the shape of the letter U can be used. Use of such profiles has the advantage that the weight of the column is not increased unnecessarily by supporting bodies and/or spacing bodies.

Further features and advantages of the invention will follow.

DETAILED DESCRIPTION OF THE PREFERRED EMBODIMENT

Figure 1:
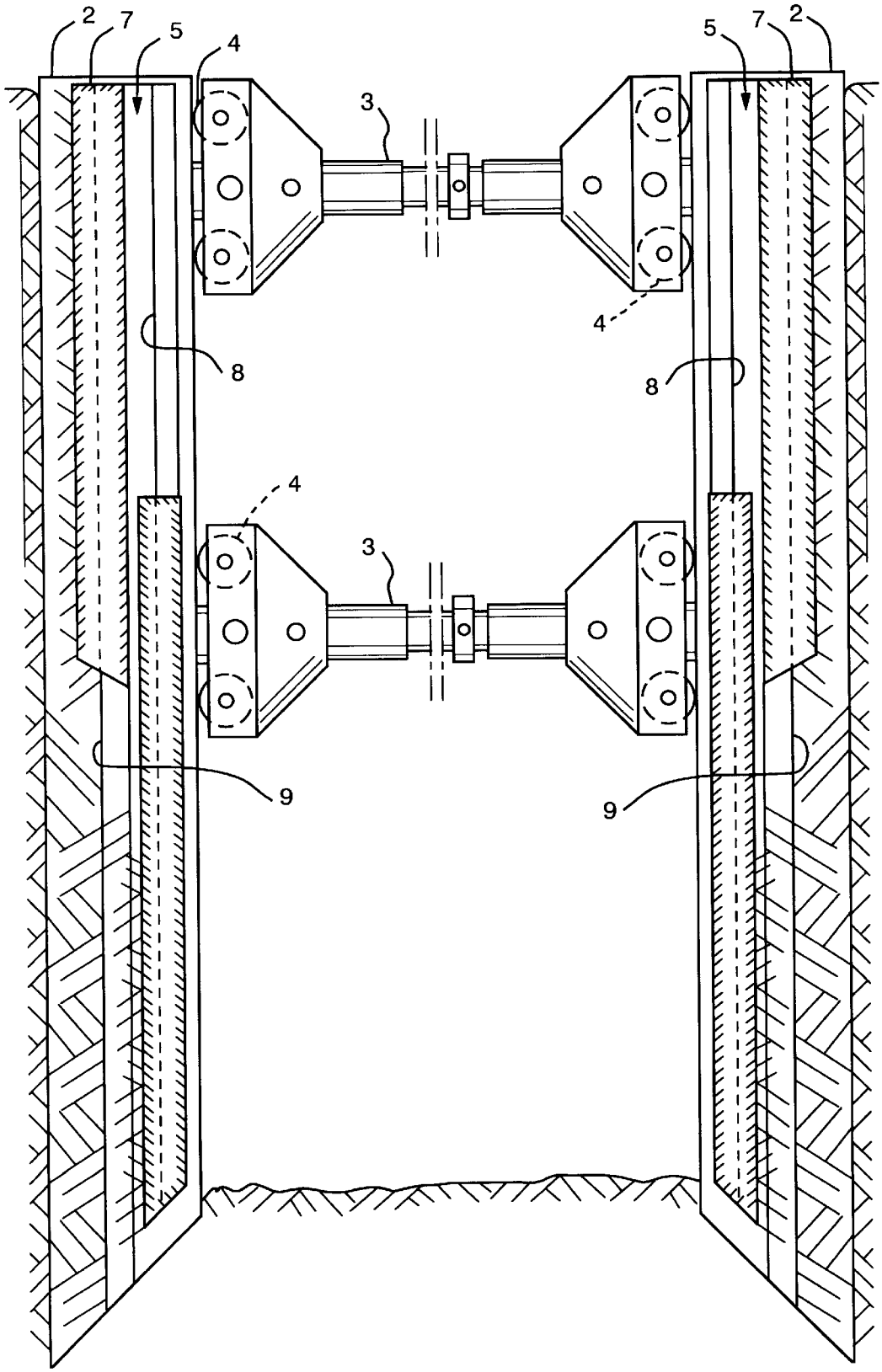
FIG. 1 is a cross section of a trench with a pair of columns in place and plates guided therein.

Referring to FIG. 1, a portion of the sheeting device for supporting two trench walls 1 includes two columns 2 located opposite one another, the columns 2 being kept at a distance from one another by two spreaders 3. The spreaders 3 have rollers 4 that roll along the side of column 2 that faces the interior of the trench. The spreaders 3 are engaged interlockingly in a guide channel 23, visible in FIG. 2, of the column 2 by means of a guide head 24 provided with rollers in a lengthwise displaceable fashion.

Figure 2:
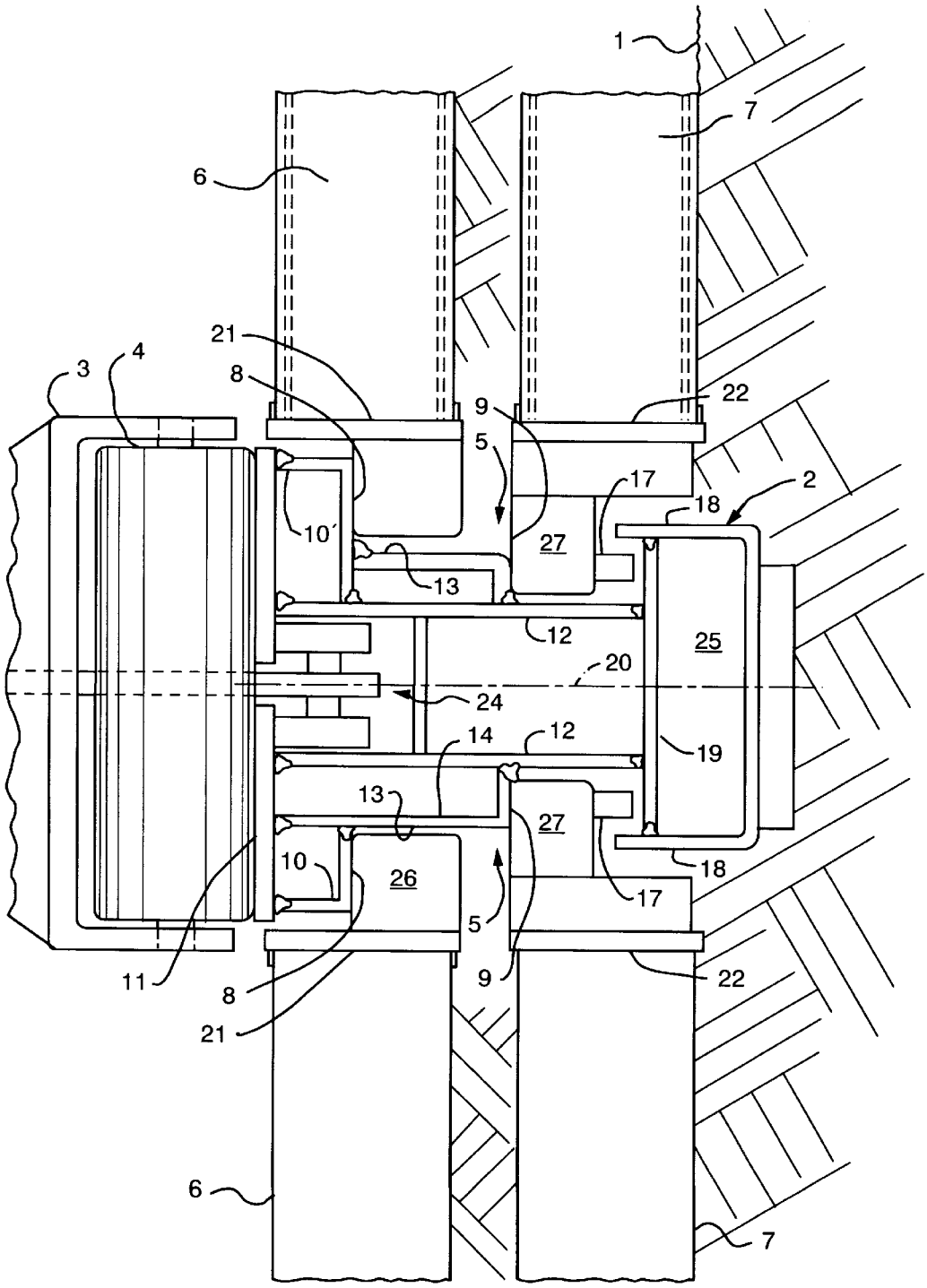
FIG. 2 is a top view of a column in FIG. 1 with plates inserted into its guide channels.

Each of the columns 2 has a guide channel 5 that is open laterally in which edges 26, 27 of an inner plate 6 and of an outer plate 7 are guided. The plates 6,7 provide support for walls of the trench 1. FIG. 2 shows the edges 26, 27 of the plates 6, 7 as well as the column 2 with a pair of guide channels 5 in a top view. Each of the guide channel 5 has a first supporting surface 8 against which edge 26 of the inner and lower plate 6 abuts. A second supporting surface 9, which is offset in the direction towards the trench wall 1, supports the edge 27 of the outer upper plate 7.

The first supporting surface 8 is formed by a spacing body 10 that is welded to a wall 11 of column 2 that faces the inside of the trench. In FIG. 2, above and below midline 20 of column 2, two different embodiments of the spacing body 10, 10' are shown. The spacing body 10' shown in the upper section is welded firstly to the wall 11 of column 2 and secondly to a wall 12 of column 2 that extends in the transverse direction of the trench. In the lower half of FIG. 2, the L-shaped spacing body 10 is shown as welded firstly to the inside wall 11 of column 2 and secondly to a supporting surface 13 which runs in the transverse direction of the trench and is part of a supporting body 14 that forms a second supporting surface 9. The supporting body 14 in turn is welded to the inside wall 11 of the column 2 and secondly to the transverse wall 12 of the column 2. On the other hand, in the upper half, a supporting body 14' is provided which is welded firstly to the supporting surface 8 of the spacing body 10' and secondly to the wall 12 of the column 2 that runs transversely.

In both cases, the surfaces 13 of the supporting bodies 14, 14' form a stop for an end face of the edge 26 of the inner plate 6. In terms of operation, the embodiments of the supporting bodies 14, 14' and of the spacing body 10, 10' shown in the upper and lower halves of FIG. 2 are analogous.

The marginal area 27 of the outer and upper plate 7 abuts the supporting surface 9. On an opposite side, a projecting strip 17 is provided in the marginal area 27. The strip 17 fits behind a strip 18 that projects into the interior of the guide channel 5 at an outer wall 19 of the guide channel 5.

The edges 26, 27 of the inner plate 6 and of the outer plate 7, which have different designs, are each formed by extension elements 21, 22 that are located on lateral edges of the base plates. As a result, the same base plates can be used to manufacture the inner plates 6 and the outer plates 7 with different extension elements 21, 22 in each case that form the edges 26, 27. In the part of the column 2 that faces the trench wall 1, a backfilling channel 25 is provided through which sand or earth can be added when the column 2 is pulled. The sand or earth emerges at a lower end of the column 2 after an outlet opening is opened in order to fill the space that becomes free when the column 2 is pulled.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. Sheeting device for supporting walls of a trench with a stepped cross section, comprising:

pairs of inner plates;

pairs of outer plates corresponding to said inner plates;

a plurality of columns located opposite one another pairwise at intervals along a length of the trench and are held apart by spreaders devices, said columns having guide channels on both sides thereof to receive edges of said plates, wherein the plates are supported in a direction towards an interior portion of the trench on first supporting surfaces of the respective column, the edges being engaged interlockingly in said guide channels; and at least one second supporting surface provided in each guide channel, said at least one second supporting surface being offset relative to a corresponding one of the first supporting surfaces both in a lengthwise direction of the trench toward the middle of the respective one of the columns and also in a transverse direction toward a wall of the trench, wherein at least one of the edges of the corresponding one of the outer plates abuts the at least one second supporting surface.

2. Sheeting device according to claim 1, wherein a supporting body is disposed in each guide channel, said body having an end face that forms the at least one second supporting surface and having a surface that is at right angles to said end face that forms a contact surface for one of the edges of one of the inner plates.

3. Sheeting device according to claim 2, wherein the supporting bodies are formed by a steel profile that is bent at right angles and runs in a lengthwise direction of the guide channel.

4. Sheeting device according to claim 1, further comprising:

a spacing body disposed in each guide channel, said spacing body having an end face that forms one of the first supporting surfaces.

5. Sheeting device according to claim 1, wherein the spacing bodies are formed by a steel profile that is bent at right angles and runs in a lengthwise direction of the guide channel.

6. Sheeting device according to claim 1, wherein a wall of the guide channel that faces the trench wall has a strip that projects into the guide channel that interlocks with a projecting strip on the edge of one of the outer plates.

7. Sheeting device according to claim 1, wherein the edges of the inner plates and of the outer plates are each formed by different extension elements that are disposed at marginal edges of a uniform baseplate.

8. Sheeting device for supporting walls of a trench with a stepped cross section, comprising:

inner plate means for supporting walls of a trench;

outer plate means, corresponding to said inner plate means, for supporting walls of a trench;

column means, for supporting said plate means using guide channels formed therein to receive portions of said plate means, said column means including first supporting means for supporting a first subset of said plate means; and second supporting means, for supporting a second subset of said plate means different from said first subset, said second supporting means being offset relative to a corresponding one of said first supporting means both in a lengthwise direction of the trench toward the middle of the respective one of the column means and also in a transverse direction toward a wall of the trench.

9. Sheeting device according to claim 8, further comprising:

supporting body means, disposed in said guide channel means, said supporting body means having an end face that forms the second supporting means and having a surface that is at right angles to said end face that forms a contact surface for the end face of said inner plate means.

10. Sheeting device according to claim 9, wherein said supporting body means is formed by a steel profile that is bent at right angles and runs in a lengthwise direction of said guide channel means.

11. Sheeting device according to claim 8, further comprising:

spacing body means disposed in said guide channel means, said spacing body means having an end face that corresponds to said first supporting surface means.

12. Sheeting device according to claim 11, wherein the spacing body means is formed by a steel profile that is bent at right angles and runs in a lengthwise direction of said guide channel means.

13. Sheeting device according to claim 8, wherein a wall of the guide channel means that faces the trench wall has strip means for projecting into the guide channel means and for interlocking with a strip means on an end of one of said plate means.

14. Sheeting device according to claim 8, wherein the edges of the inner plate means and of the outer plate means are each formed by different extension elements that are disposed at marginal edges of a uniform baseplate.

15. A column for a sheeting device that supports walls of a trench, comprising:

a guide channel that receives edges of plates that support walls of the trench, a first supporting surface that supports a first subset of the plates; and a second supporting surface, offset relative to the first supporting surfaces both in a lengthwise direction of the trench toward a middle portion of the column and also in a transverse direction toward a wall of the trench, said second supporting surface supporting a second subset of the plates different from the first subset.

16. A column for a sheeting device, according to claim 15, further comprising:

a backfill channel, disposed in the column, and having an opening therein to allow material to fill a void provided when the column is removed.

* * * * *